US009103589B2

(12) United States Patent
Sullivan

(10) Patent No.: US 9,103,589 B2
(45) Date of Patent: Aug. 11, 2015

(54) CLOTHES DRYER EXHAUST DEVICE

(71) Applicant: Lowell R. Sullivan, Mt. Juliet, TN (US)

(72) Inventor: Lowell R. Sullivan, Mt. Juliet, TN (US)

( * ) Notice: Subject to any disclaimer, the term of this patent is extended or adjusted under 35 U.S.C. 154(b) by 168 days.

(21) Appl. No.: 14/038,822

(22) Filed: Sep. 27, 2013

(65) Prior Publication Data

US 2014/0082956 A1 Mar. 27, 2014

Related U.S. Application Data

(60) Provisional application No. 61/706,563, filed on Sep. 27, 2012.

(51) Int. Cl.
*F26B 25/00* (2006.01)
*D06F 58/20* (2006.01)

(52) U.S. Cl.
CPC ..... *F26B 25/007* (2013.01); *D06F 58/20* (2013.01); *F26B 25/009* (2013.01)

(58) Field of Classification Search
CPC ..... F26B 19/00; F26B 21/00; F26B 25/00; F26B 25/001; D06F 58/00; D06F 58/20; D06F 58/22; D06L 1/00; F24C 3/00
USPC ..... 34/79, 80, 82, 595, 610; 68/19, 20; 8/137, 149; 454/184, 187, 339
See application file for complete search history.

(56) References Cited

U.S. PATENT DOCUMENTS

| | | | | |
|---|---|---|---|---|
| 4,890,396 | A * | 1/1990 | King | 34/235 |
| 4,969,276 | A * | 11/1990 | Walsh | 34/90 |
| 5,555,643 | A | 9/1996 | Guasch | |
| 5,628,122 | A | 5/1997 | Spinardi | |
| 5,706,588 | A * | 1/1998 | Dausch et al. | 34/327 |
| 6,016,610 | A * | 1/2000 | Sears | 34/82 |
| 6,122,835 | A * | 9/2000 | Khanyutin | 34/79 |
| 6,671,977 | B2 | 1/2004 | Beaumont | |
| 7,047,664 | B1 | 5/2006 | Martinez | |
| 7,412,853 | B2 * | 8/2008 | Hong et al. | 68/19.1 |
| 7,448,146 | B2 * | 11/2008 | Cho et al. | 34/601 |
| 8,006,407 | B2 * | 8/2011 | Anderson | 34/381 |
| 8,250,778 | B2 * | 8/2012 | Hodges | 34/601 |
| 8,468,716 | B1 * | 6/2013 | Walker et al. | 34/435 |
| 8,893,399 | B2 * | 11/2014 | Gregory et al. | 34/82 |
| 2002/0023368 | A1 * | 2/2002 | Beaumont | 34/79 |
| 2009/0277034 | A1 * | 11/2009 | Wilson | 34/82 |
| 2014/0082956 | A1 * | 3/2014 | Sullivan | 34/82 |

FOREIGN PATENT DOCUMENTS

| | | | | |
|---|---|---|---|---|
| CN | 2665187 Y | * | 12/2004 | |
| GB | 622661 A | * | 5/1949 | |
| JP | 2004344336 A | * | 12/2004 | D06F 58/02 |

* cited by examiner

*Primary Examiner* — Stephen M Gravini
(74) *Attorney, Agent, or Firm* — Daniel Boudwin; Global Intellectual Property Agency LLC

(57) ABSTRACT

A clothes dryer exhaust line blower system is provided that assists a clothes dryer venting hot air and lint from the dryer interior and through the length of the dryer ducting to maintain a clear pathway and maintain the dryer's efficiency over time. A Y-pipe having a main exhaust line and an intermediate line is installed on the dryer exhaust port and connects the dryer exhaust outlet to an existing dryer duct that is adapted to communicate dryer exhaust from the dryer to the exterior of a dwelling. An intermediate section of the Y-pipe connection includes an electric blower assembly that functions as an auxiliary venting means, which generates air pressure to assist the dryer assembly vent the heated air through the exhaust conduit during the drying process. The blower is electrically driven and is controlled via a manual switch or timer switch that functions in conjunction with the drying cycles of the dryer.

7 Claims, 3 Drawing Sheets

CLOTHES DRYER EXHAUST DEVICE

CROSS REFERENCE TO RELATED APPLICATION

This application claims the benefit of U.S. Provisional Application No. 61/706,563 filed on Sep. 27, 2012, entitled "Blow-Jet Dryer Cleaning System." The above identified patent application is herein incorporated by reference in its entirety to provide continuity of disclosure.

BACKGROUND OF THE INVENTION

1. Field of the Invention

The present invention relates to commercial and domestic clothes dryers and accessory devices therefor. More specifically, the present invention pertains to a dryer vent blower assembly that rapidly expels accumulated lint and debris from within the exhaust vent of a clothes dryer for efficient use thereof over the life of the dryer.

Clothes dryers are common household appliances that tumble dry clothes using a flow of air to evaporate moisture from recently washed or moistened clothing items. Most dryers operate using a heated air flow, which increases evaporation and reduces the drying time for a given load of laundry. The heated air is circulated through the interior of the dryer and then exhausted therefrom. The exhausted air must be evacuated from the dryer and expelled outside of the home, as the expelled air is at an elevated temperature, contains considerable moisture content, and further includes a large quantity of lint that cannot otherwise be deposited within the interior of the home.

Clothes dryer exhaust systems connect the dryer to an exterior vent by way of an elongated pipe, which is generally limited to a given pipe length and interior smoothness to prevent backpressure that would hinder the expulsion of air from the dryer. However, these restrictions as imposed by local ordinances and state laws are not always followed, and it is not uncommon to find dryer vent pipes having overly long runs and installed using accordion-style ducting, both of which readily trap particulate matter exiting the dryer and clog the exhaust vent. The accumulation is caused by the inability of the dryer to pump the hot air and particulate matter through the length of the pipe (head loss) and lint clogging the conduit within the nooks and crannies of a corrugated or accordion exhaust pipe. This accumulated lint reduces the effectiveness of the dryer system and causes hot air and lint to be expelled into the dwelling interior, which is problematic for a number of reasons.

The particulate matter is mostly cotton lint, dust, and dirt that exits the dryer. Build-up of this material can cause blockages in the dryer exhaust system, preventing the dryer from properly exhausting the hot air and thus reducing its ability to dry clothes within the tumbler. The moist air within the dryer must be evacuated to adequately dry the clothing, where the inability to exhaust this air increasing the required drying time of the clothes and thus the operation time of the dryer. This represents a considerable burden on the household electrical system, and when taken across an entire community and region can lead to a significant expenditure of electricity that is otherwise unnecessary given the efficiency of most modern electrical appliances.

Maintaining a clear and smooth pathway for the dryer exhaust line is critical to maintaining the as-advertised efficiency of the clothes dryer, and prevents deterioration of this efficiency and thus eliminates unnecessary cost expenditures. It has been estimated that by increasing the air flow through the installed dryer duct system and maintaining a free-flowing pathway, an equipped dryer will operate for at time 5% to 10% less than otherwise per laundry load than if operated with a partially or fully clogged exhaust line. Since the household dryer is a major user of household energy, this impacts the yearly energy required to operate a home. Conservatively estimating that a dryer power usage is roughly 2500 kWh, is operated for an average 45 minutes per use, and is operated to dry six loads of laundry per week, the savings to the power grid are substantial. With over 90 million household dryers installed in the United States alone, a reduction of only 7% time per drying load, the KWH savings can reach 70,870,00 kWh per week.

Along with impacts to efficiency and increased energy usage, accumulated lint and debris settled within the dryer exhaust lines represents a considerable fire hazard and health risk. This debris is highly flammable and is generally not readily removable after being accumulated, except by way of complete removal of the exhaust line and subsequent replacement. This cost and time burden makes such an activity less likely to occur, and therefore accumulated lint and dryer debris remains in the line and the risk of fire remains. Therefore, a solution is required to maintain a dryer vent exhaust line to prevent accumulation of lint, for both a cost and energy savings purpose and for a household safety perspective. Furthermore, the ability of the dryer to evacuate the lint and moist air from the dwelling is seriously hampered if the exhaust line is clogged, thereby causing the lint and moisture to enter the home and create a risk to those with indoor allergies.

The present invention describes a clothes dryer maintenance and efficiency device, whereby an auxiliary blower system is installed in-line with the dryer exhaust line to evacuate the line of accumulated lint and to reduce backpressure on the system for the operating dryer. The system comprises a high pressure air pump that is manually operable and operable over given intervals in conjunction with an existing clothes dryer, whereby a burst of high pressure air is sent through the dryer exhaust line and out of the dryer vent for a short period of time. The device creates a high pressure vortex that clears out lint and further reduces backpressure on the dryer system, maintaining a clear pathway for the dryer hot air and for lint to escape the line.

2. Description of the Prior Art

Devices have been disclosed in the prior art that relate to dryer lint catches, traps, and exhaust devices. These include devices that have been patented and published in patent application publications. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 5,628,122 to Spinardi discloses a lint remover system for a clothes dryer that utilizes an enclosure that supports a level of water for capturing lint before exhausting the dryer hot air. The device comprises an enclosure that accepts the dryer hot air therein, wherein the hot air is directed to the surface of a pool of water therein by way of an inlet vane. Lint is deposited in the water before exiting an exhaust line, while the water is continually refreshed every time the neighboring water drains water. While providing a means to eliminate the accumulation of lint within a dryer exhaust line, the Spinardi device incorporates the use of water and removes the lint before entering the exhaust line by way of water filtration. The present invention is a secondary pumping system that assists the dryer in evacuating the exhaust line and maintaining its clear pathway over time. No water plumping and wasted water is required by the present invention.

U.S. Pat. No. 6,671,977 to Beaumont discloses a lint catch appliance attachable to a dryer for intercepting and containing lint therein as it is vented through a dryer exhaust line. The device comprises a housing having an inlet and outlet that is installed in line with a dryer exhaust. Within the device, and similar to the Spinardi device, a reservoir of water is supported for filtering lint and debris from the air flowing through the housing. While preventing lint build-up in the exhaust line, the Beaumont is in the same vain as the Spinardi device and differs from the structure and intent of the present invention.

Finally, U.S. Pat. No. 7,047,664 to Martinez discloses a method of cleaning a clothing dyer ducting line in a household by connecting a blower motor to the line to evacuate its contents. The method entails removing the ducting from the dryer, connecting a blower motor, and using the blower to move line within the dryer exhaust ducting toward the wall vent. The lint is then caught in the vent by a catcher and thereafter removed. While disclosing a secondary blower for cleaning out ducting, the Martinez method fails to disclose a working blower system that is functional in connection with a working dyer, or one that does not require removal of ducting from the dyer for operation.

The present invention comprises a new and novel auxiliary exhaust blower for a clothes dryer that assists the dryer evacuating the dryer air and lint through the dryer ducting. The device functions as a means to maintain the dryer efficiency and reduce clogging of the exhaust line over repeated uses. The blower assembly includes a Y-pipe connector that secures to the exhaust port of a clothes dryer and directs exhausted air into the exhaust ducting, while also accommodating the auxiliary blower motor and fan for increasing the air pressure in the exhaust duct to clear its lines.

The present invention contemplates a new and novel means of reducing energy consumption of a household appliance, wherein clothes dryer exhaust lines are maintained at peak efficiency over the course of their use. It is submitted that the present invention substantially diverges in design elements from the prior art, and consequently it is clear that there is a need in the art for an improvement to existing clothes dryer exhaust venting devices. In this regard the instant invention substantially fulfills these needs.

SUMMARY OF THE INVENTION

In view of the foregoing disadvantages inherent in the known types of clothes dryer exhaust devices now present in the prior art, the present invention provides a new auxiliary exhaust device that can be utilized for providing convenience for the user when maintaining a clothes dryer efficiency and assisting in the evacuation of air and lint from the dryer system during operation.

It is therefore an object of the present invention to provide a new and improved clothes dryer exhaust device that has all of the advantages of the prior art and none of the disadvantages.

It is another object of the present invention to provide a clothes dryer exhaust device that improves and maintains the efficiency of a clothes dryer during operation by assisting the clothes dryer in evacuating air and lint through its exhaust ducting.

Another object of the present invention is to provide a clothes dryer exhaust device that provides a universal connector for existing clothes dryer devices, whereby a Y-pipe connects in-line with the clothes dryer exhaust port and increases the exhaust pressure to communicate exhausted lint and air therethrough.

Yet another object of the present invention is to provide a clothes dryer exhaust device that includes an electrically driven fan that operates by way of a timer switch, in conjunction with the clothes dryer operation, or via manual input between clothes dryer uses.

Another object of the present invention is to provide a clothes dryer exhaust device that aims to reduce energy consumption and energy costs to the consumer by clearing the exhaust ducting of a clothes dryer exhaust, and thereafter maintaining it for continued efficient use.

A final object of the present invention is to provide a clothes dryer exhaust device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
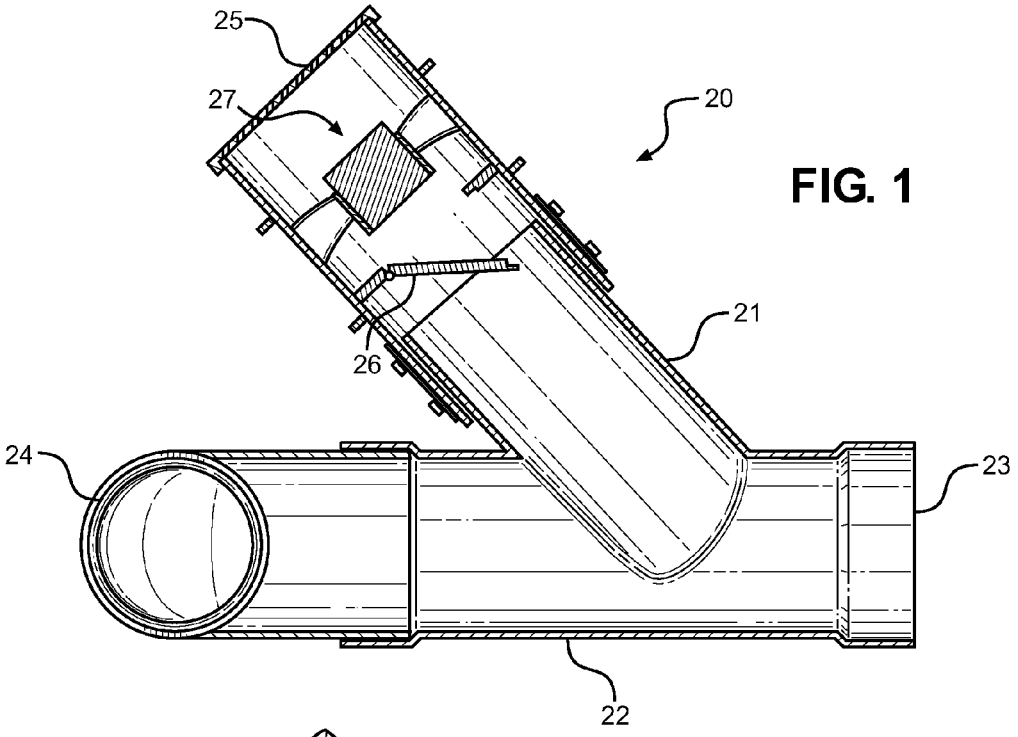
FIG. 1 shows a cross sectional front view of the clothes dryer exhaust device of the present invention.

Reference is made herein to the attached drawings. Like reference numerals are used throughout the drawings to depict like or similar elements of the clothes dryer exhaust device. For the purposes of presenting a brief and clear description of the present invention, the preferred embodiment will be discussed as used for clearing the ducts of a clothes dryer and assisting the clothes dryer in evacuating air and lint therefrom. The figures are intended for representative purposes only and should not be considered to be limiting in any respect.

Referring now to FIG. 1, there is shown a cross sectional front view of the clothes dryer exhaust device 20 of the present invention. The device comprises a Y-fitting adapted to be fitted in-line with existing exhaust duct for a clothes dryer, wherein the device secures at one end 24 to the rear of a clothes dryer at the dryer vent location, and then secures to the exhaust duct of the clothes dryer at a second end 23. Between the two ends is an intermediate section 21 that is adapted to support a blower assembly 27 therein and provide forced air into the dryer exhaust duct to force air, lint, and moisture therefrom prior to the dryer being utilized and during its operation, as determined by its setup and user preferences.

The device comprises a Y-fitting having an elongated exhaust line 22 comprising a first end 24 and a second end 23. Along the exhaust line 22 includes an elongated section that attaches to a curved end fitting at the first end, wherein the end fitting comprises a curved section to place the first end 24 in connection with the exhaust port of the clothes dryer along the backside thereof. The second end 23 of the exhaust line 22 is adapted to secure to existing ductwork within a dwelling, which provides a conduit for communicating the hot air from the dryer to a vent outside of the dwelling to evacuate the same.

Along the length of the exhaust line 22 is an intermediate section 21 that connects to the exhaust line to form a Y-shaped assembly. The intermediate section 21 comprises an elongated section of pipe having an open proximal end 25 and a distal end that terminates against the exhaust line 22 and allows communication of air directly thereinto and in a direction towards the exhaust line second end 22. The open proximal end 25 of the intermediate section includes a screen member 25 to prevent lint or debris from entering or exiting the section 21, while allowing air from the environment to be drawn into the intermediate section 21 and forced into the exhaust line 22.

Adjacent to the proximal end 25 of the intermediate section 21 is a blower assembly 27, which comprises an electrically driven and controlled fan assembly that draws air from the environment in through the proximal end of the section 21, pressurizes the same and accelerates the air towards the distal end of the section 21. The high pressure air is forced into the exhaust line 22 to assist the dryer in clearing the dyer duct of static air and lint prior to and during the dryer operation. The blower assembly 27 therefore acts as a secondary air pressure source that maintains the ductwork in a clear and open manner for continued efficient operation of the clothes dryer, which depends greatly on its ability to evacuate hot and moist air from its dryer interior to remove moisture from the clothes therein.

The blower assembly 27 comprises a mechanical fan driven by an electric motor and having fan blades that generate a high pressure air flow through the length of the intermediate section 21 and into the exhaust line 22, and thereafter into the dryer ductwork to evacuate the air and lint from the dryer. The blower assembly is driven by electrical power and a control assembly, which may comprise a circuit that takes input from the dryer itself, is built into the dryer, is manually controlled by a user, or is manually set via a timer circuit switch. The goal is to provide a blower assembly and means of communicating pressurized air into the dryer ductwork to clear the same of static air and built-up lint, while at the same time offering a means to assist the user in evacuating air from the dryer tumbler during use.

The control circuit for the blower can be manually activated by way of a switch, or programmed to function at a given period without direct user activation. This energizes the electric motor driving the fan blade assembly, which creates the air flow through the intermediate section 21. Alternate configuration contemplate receiving activation signals directly from the dryer when the dryer is operational, or just prior to its operation. This embodiment contemplates wiring the present blower assembly and control circuit with the electrical operation of the clothes dryer itself, as opposed to allowing independent control thereof. This embodiment is ideal for incorporating the present invention into a new clothes dryer design, while the preferred embodiment (manual input/timed input) is preferable for deploying the present invention on existing clothes dryer units.

To prevent the air and lint generated in the clothes dryer from exiting the system, a normally closed, one-way flapper valve 26 is disposed within the intermediate section 21 just downstream from the blower assembly 27. The flapper valve 26 prevents backflow of air from the exhaust line 22, and thus prevents air and lint from the clothes dryer from exiting the open proximal end 25 of the assembly. The flapper valve 26 opens in the direction of the air flow from the blower assembly and towards the distal end of the intermediate section. When the blower assembly 27 is operational, the flapper valve 26 opens, and when the blower assembly 27 ceases operation, the flapper valve is spring biased to return to its normally-closed position.

Figure 2:
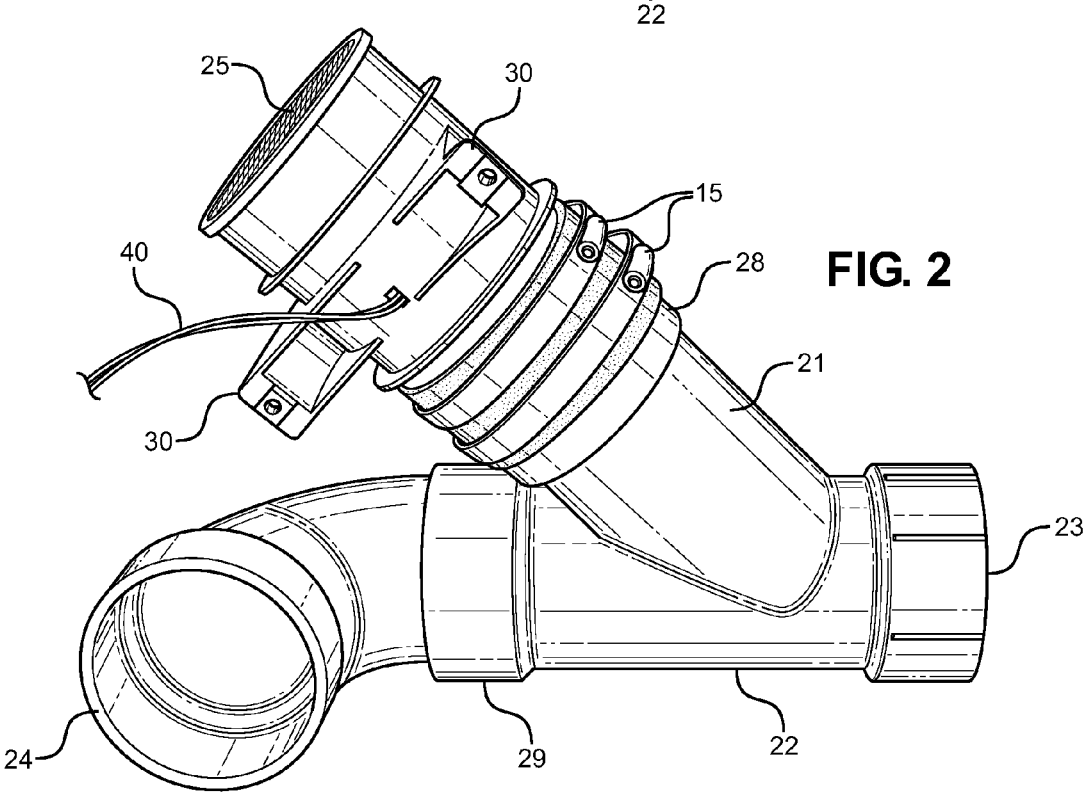
FIG. 2 shows a rear view of the clothes dryer exhaust device of the present invention.

Referring now to FIG. 2, there is shown a front view of the clothes dryer exhaust device of the present invention. To allow the assembly to connect to a given clothes dryer vent, the exhaust line 22 connects to a specific style and sized connector along its first end 24. A pipe fitting 29 is provided to allow a different sized or shaped first end 24 to be attached thereto for a given clothes dryer. Further still, specific style connector may be used between the first end 24 of the exhaust line 22 and the clothes dryer exhaust port, as desired by the given application and the given clothes dryer being connected to. After the first end 24 is secured to the dryer exhaust port, the second end 23 is secured to the dryer exhaust duck and the intermediate section 21 is secured to the backside of the clothes dryer using the attachment clips 30 extending therefrom.

The attachment clips 30 are extensions having a planar termination that is adapted to allow both clips 30 to lie flush against a flat surface (e.g. the backside surface of the clothes dryer). Each of the clips includes an aperture therethrough that allow for a fastener to be connected to the backside of the clothes dryer when fastening the clips thereto. Further provided along the intermediate section 21 are wiring connections 40 for the blower assembly, which are adapted to be connected directly to a power source, to an external controller unit (switch/timer switch), or directly to the clothes dryer itself.

To prevent dirt and debris from entering the intermediate section 21 of the assembly and interfering with the blower assembly therein, the open proximal end 25 of the intermediate section 21 includes a perforated screen. A perforated screen prevents lint from entering the otherwise open proximal end 25 of the intermediate section 21 when the blower assembly 27 is operational, thereby preventing any debris from entering the interior of the dwelling during use. The perforated screen blocks particles and debris while allowing air to be drawn therethrough as the blower is in operation.

Referring again to FIG. 2, the intermediate section 21 includes a segmented construction. This embodiment contemplates an upper section 28 that is affixed to the intermediate section 21, wherein the upper section 28 includes the blower assembly and clips 30 for securing the intermediate section 21 to the backside of the clothes dryer. As shown in FIG. 2, the upper section 28 is fastened to the intermediate section 21 by way of hose clamps 28 and a seal thereunder. It is also contemplated that the intermediate section 21 and upper section 28 are merged and a unitary pipe structure.

Figure 3:
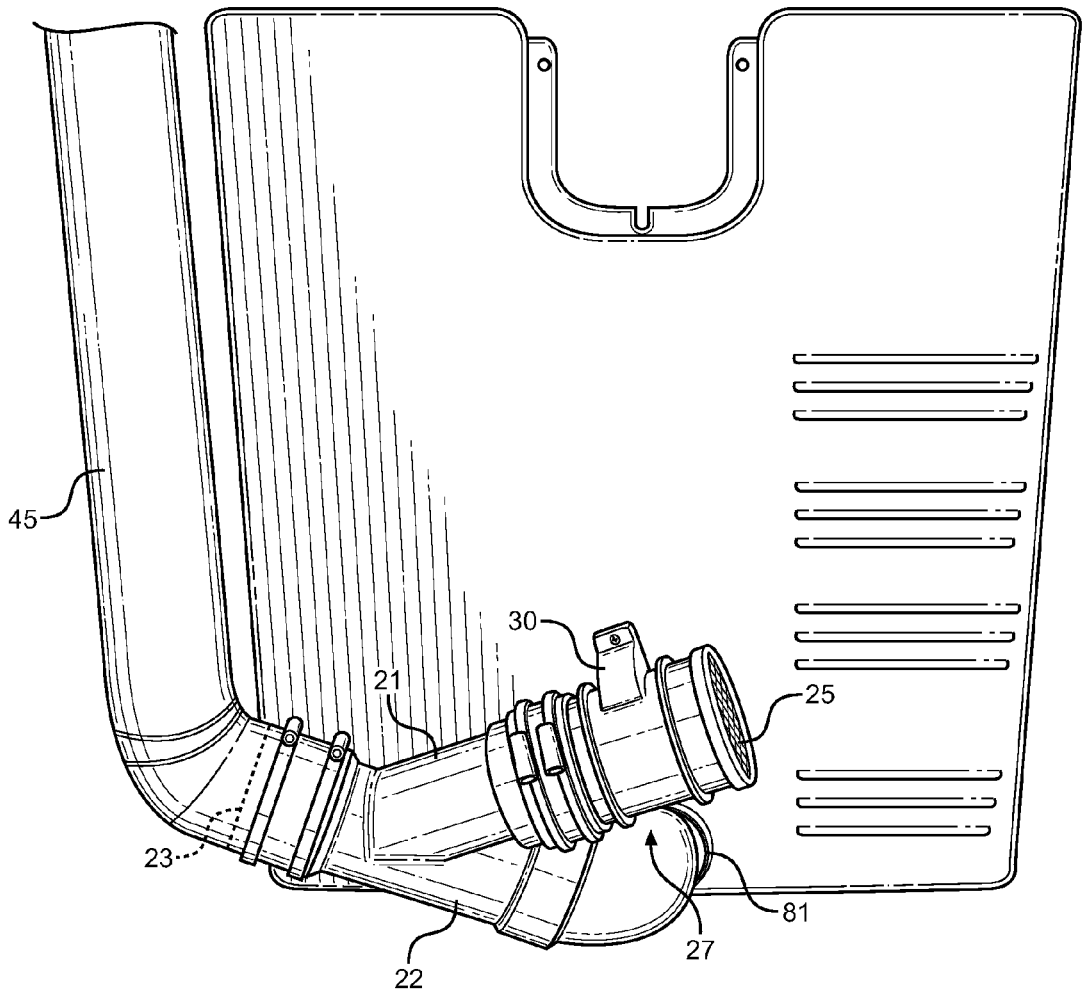
FIG. 3 shows a view of the clothes dryer exhaust device of the present invention in a working state, connected to the exhaust port of a clothes dryer.

Referring now to FIG. 3, there is shown a view of the dryer exhaust device of the present invention in a working state and connected to the backside surface of a clothes dryer. The first end of the exhaust line 22 is connected to the exhaust port 81 of the clothes dryer, while the second end 23 of the exhaust line 22 is secured to an exhaust duct 45 to allow communication of air and lint from the dryer to the exterior of the dwelling during the operation of the clothes dryer. The intermediate section 21 is secured to the backside of the dryer by way of the attachment clips 30, while the screened, open end 25 of the intermediate member is open to the atmosphere to draw in air. The internal blower assembly 27 draws in the air and pressurizes it, forcing it into the exhaust line 22 and through the second end 23 thereof and into the exhaust duct 45. This clears the exhaust duct 45 of its lines and assists the clothes dryer during operation.

Figure 4:
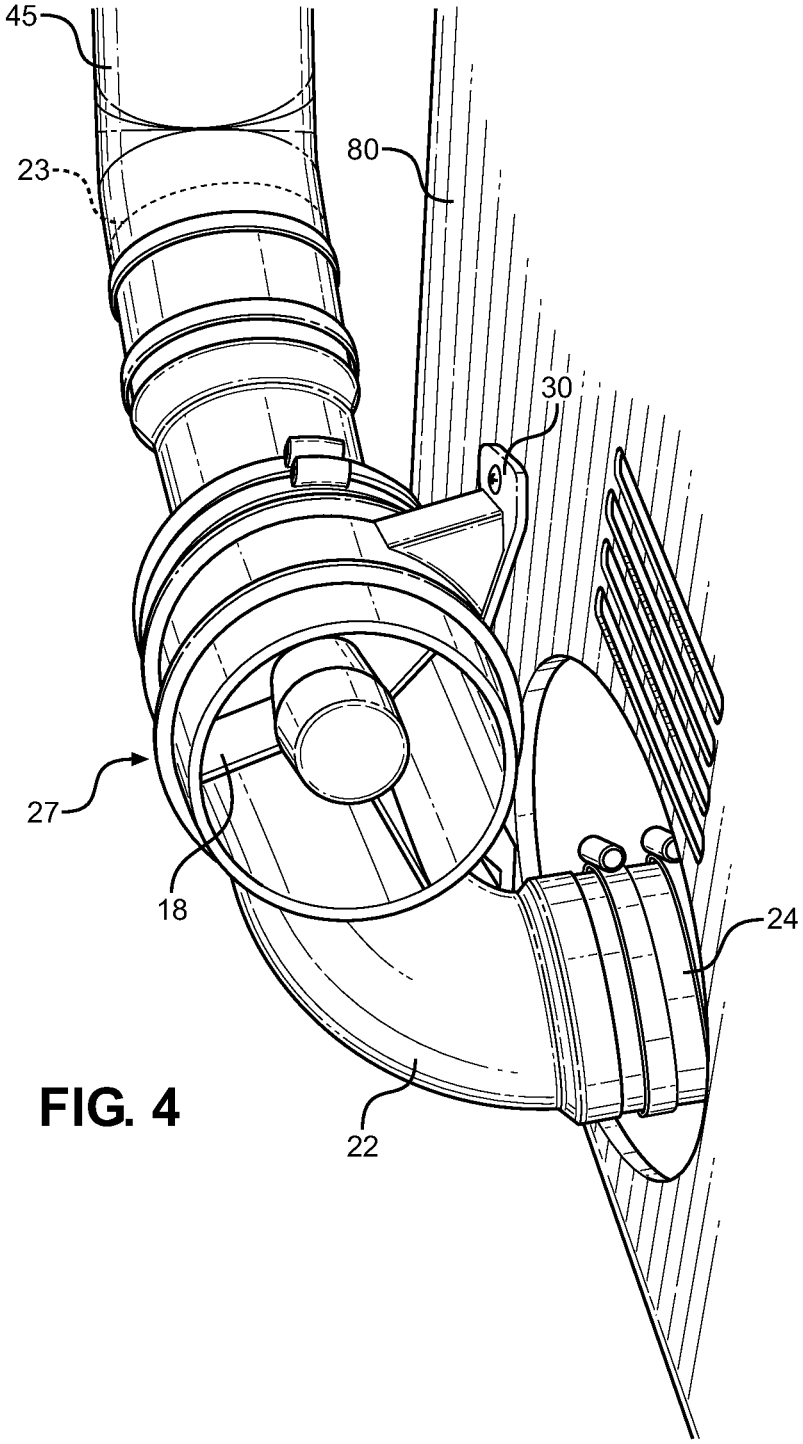
FIG. 4 shows an end view of the clothes dryer exhaust device of the present invention in a working state.

Referring finally to FIG. 4, there is shown a view of the blower assembly 27 through the proximal end of the intermediate section with the screen removed. From this view, the blower assembly 27 fan blades 18 are visualized, which are utilized to pressurize air and direct it from the environment towards the exhaust line second end 23 and through the existing duct line 45. As previously noted, the exhaust line 22 first end 24 secures to the clothes dryer exhaust port to accept the heated and moisturized air therefrom, which is communicated to the second end 23 thereof for sending the same through the dryer ducting 45. The clips 30 provide a means of mounting the assembly to the dryer and maintain the position thereof during normal operation of the clothes dryer and during operation of the blower assembly 27.

The blower assembly 27 is operated by a manual switch or timer circuit switch, wherein the blower assembly 27 cleans the dryer exhaust duct of debris and ensures the dryer retains its as-advertised efficiency. The blower assembly preferably creates a high pressure air flow with a mass flow rate of up to 500 cubic feet per minute (cfm), which is operated prior to the dryer be operated or at the beginning thereof. The blower assembly can remain operational for a given time (15-30 seconds) before being shut off, and the clothes dryer will continue to operate thereafter. Alternatively the blower assembly can be run for periodic maintenance between dryer uses, or during the entire operation for the dryer, as desired by the user.

A clogged dryer duct, which is a common problem among households, can lead to fires, injuries, or even death. Some individuals may employ a service company to come to their house and clean the ductwork and vent, but this can be expensive and not very practical over time. The present invention describes a dryer vent cleaning assembly that maintains a clear clothes dryer duct and assists the dryer in evacuating air and lint therethrough. The device comprises a three-way attachment that fits between a dryer exhaust port and exhaust duct, and includes a blower assembly attached thereto. The blower assembly includes a timer for automatic operation, or may be manually activated or activated by way of electrical communication with the attached clothes dryer. The blower assembly forces air through the vents at a high flow rate, which removes all lint and foreign objects contained therein that can otherwise lead to a fire or clogging. This prevents dryer vents from becoming clogged and potentially starting house fires, which reduces the chance of burning out dryer units and having to repair or replace them.

The device comprises of a self-contained dryer vent cleaning system, and is preferably constructed of a polyvinyl chloride (PVC) three-way connection assembly. The assembly attaches to a conventional clothes dryer, the existing ductwork connected to the outside vent, and includes a blower assembly. The device attaches to the backside of the clothes dryer and the tri-connector is connected to the dryer exhaust port. A manual power switch may be mounted to the wall behind the dryer for manual operation, or alternatively the device includes a timer to ensure the unit is used regularly. The entire system is constructed of fire resistant materials, affording additional safety thereto.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clothes dryer exhaust device, comprising:

an elongated exhaust line comprising a hollow pipe having a first end and a second end;

an intermediate section comprising an elongated pipe having a proximal and distal end;

said distal end of said intermediate section connecting to said exhaust line along its length;

said exhaust line and said intermediate section forming a substantially Y-shaped assembly;

said intermediate section proximal end comprising an internal blower assembly and an open end having a perforated screen thereover;

said blower assembly comprising a mechanical fan driven by an electric motor adapted to draw air through said perforated screen and communicate air from said proximal end to said distal end and into said exhaust line;

a one-way flapper valve within said intermediate section that is adapted to open when said blower assembly is operating and close when said blower assembly is not operating;

said first end of the exhaust line adapted to secure to a clothes dryer exhaust port;

said second end of the exhaust line adapted to secure to an exhaust duct.

2. The clothes dryer exhaust device of claim 1, wherein:

said intermediate section further comprises at least one attachment clip for securing said intermediate section to a clothes dryer rear surface.

3. The clothes dryer exhaust device of claim 1, wherein:

said blower assembly is electrically connected to a power source and a manual switch.

4. The clothes dryer exhaust device of claim 1, wherein:

said blower assembly is electrically connected to a power source and a manual switch.

5. The clothes dryer exhaust device of claim 1, wherein:

said blower assembly is electrically connected to a power source and a timer circuit switch.

6. The clothes dryer exhaust device of claim 1, wherein:

said first end of the said exhaust line comprises a curved section of pipe.

7. The clothes dryer exhaust device of claim 1, wherein:

said intermediate section further comprises a lower portion and a removably attached upper portion, said upper portion supporting said blower assembly.

* * * * *